United States Patent [19]

Dong et al.

[11] Patent Number: 4,891,107

[45] Date of Patent: Jan. 2, 1990

[54] POROUS DIAPHRAGM FOR ELECTROCHEMICAL CELL

[75] Inventors: Dennis F. Dong, Kingston; Arthur L. Clifford, Harrowsmith, both of Canada

[73] Assignee: H-D Tech Inc., Woodbridge, Canada

[21] Appl. No.: 777,483

[22] Filed: Sep. 19, 1985

[51] Int. Cl.[4] ..... C25B 13/00

[52] U.S. Cl. ..... 204/296; 204/98; 204/128; 204/257; 204/283

[58] Field of Search ..... 204/1 R, 98, 128, 252, 204/283, 296

[56] References Cited

U.S. PATENT DOCUMENTS

| | | | |
|---|---|---|---|
| 2,860,100 | 11/1958 | Krzyszkowski | 204/252 |
| 3,925,135 | 12/1975 | Grot | 204/296 |
| 3,944,477 | 3/1976 | Argade | 204/296 |
| 3,969,201 | 7/1976 | Oloman et al. | 204/83 |
| 4,031,000 | 6/1977 | Nakamura et al. | 204/296 |
| 4,118,305 | 10/1978 | Oloman et al. | 204/265 |
| 4,209,368 | 6/1980 | Coker et al. | 204/283 |
| 4,342,636 | 8/1982 | Chang et al. | 204/296 |
| 4,406,758 | 9/1983 | McIntyre et al. | 204/98 |
| 4,431,494 | 2/1984 | McIntyre et al. | 204/83 |
| 4,445,986 | 5/1984 | McIntyre et al. | 204/98 |
| 4,457,953 | 7/1984 | McIntyre et al. | 427/113 |
| 4,511,441 | 4/1985 | McIntyre et al. | 204/98 |
| 4,534,845 | 8/1985 | McIntyre et al. | 204/283 |

FOREIGN PATENT DOCUMENTS 0086896 8/1983 European Pat. Off. .

OTHER PUBLICATIONS

*McGraw-Hill Encyclopedia*, "Polyolefins Resins", p. 813, 1982.

Chemical and Engineering News, Mar. 12, 1984, "Trickle Bed Electrolytic Cell for Peroxide Developed".

Celgard Microporous Polypropylene Film (10 pages).

Paper presented at TAPPI Pulping Conference, Houston, TX, Oct., 1983, Brown, McIntyre, Dong, and Phillips.

Paper #399, presented at the 1982 Montreal Meeting of the Electrochemical Society entitled, "Electrolytic Synthesis of Hydrogen Peroxide in a Trickle Bed Cell", McIntyre et al.

*Primary Examiner*—John F. Niebling
*Assistant Examiner*—Kathryn Gorgos
*Attorney, Agent, or Firm*—Andrew E. Pierce

[57] ABSTRACT

A porous diaphragm is disclosed for use in an electrochemical cell having at least one electrode characterized as porous and self-draining. The diaphragm provides a uniformity of flow of an electrolyte through the diaphragm even when exposed to varying electrolyte head pressures. The porous diaphragm of the invention has a plurality of layers of a microporous polyolefin film or a composite comprising the microporous polyolefin film and a support fabric resistant to deterioration upon exposure to an aqueous solution of an ionizable compound.

4 Claims, 2 Drawing Sheets

POROUS DIAPHRAGM FOR ELECTROCHEMICAL CELL

BACKGROUND OF THE INVENTION (1) Field of the Invention

This invention relates to electrochemical cells and more particularly to electrolytic diaphragm cells having an electrolyte permeable diaphragm and at least one self-draining electrode contacting said electrolyte permeable diaphragm.

(2) Description of the Prior Art

Packed bed chlor-alkali electrolytic cells and electrolytic cells for the production of alkaline hydrogen peroxide solutions are known from Oloman et al U.S. Pat. Nos. 3,969,201 and 4,118,305. Improvements in these cells have been disclosed by McIntyre et al in U.S. Pat. Nos. 4,406,758; 4,431,494; 4,445,986; 4,511,441; and 4,457,953. These packed bed electrolytic cells are particularly useful for the production of alkaline solutions of hydrogen peroxide.

Among known bleaching agents, hydrogen peroxide is at the present time being increasingly used, in particular for bleaching materials such as textiles or paper pulp. Hydrogen peroxide has the great advantage over other bleaching agents, in particular chlorine and its compounds, in that because of its mild action, it attacks the fibers of the material to be treated to a much lesser extent, while exerting a more durable action and giving a better finish.

Hydrogen peroxide is generally used in bleaching in the form of a stabilized alkaline solution of low peroxide concentration. The action of the hydrogen peroxide in bleaching consists essentially of destroying or decolourising the natural dyes by oxidation, or by rendering them soluble. Even though the mechanism of these reactions has been little studied, it is generally assumed that the hydrogen peroxide ion $HOO^-$ is responsible for the bleaching.

Present-day bleaching solutions based on hydrogen peroxide have the great disadvantage with respect to other conventional bleaching solutions (in particular hypochlorite-based solutions) of being relatively costly. Their widespread use is very dependent on economic considerations, particularly when large quantities of low-value material such as paper pulp are to be treated. Present-day bleaching solutions are nearly always prepared by simple dissolving and dilution, starting from commercially available chemicals. Commercially available hydrogen peroxide is a particularly costly substance, as it is manufactured only in a small number of large industrial plants, and it has therefore to be highly concentrated for storage and transport purposes before being distributed. At the present time there is a need to replace the highly concentrated, commercially available hydrogen peroxide by on site manufacturing methods which enable dilute solutions of hydrogen peroxide to be produced directly, in order to reduce bleaching costs. However, up to the present time no satisfactory method has appeared.

Hydrogen peroxide is used not only for bleaching purposes, but also in an increasing number of other processes, in particular in the pollution control field. However, treatment solutions used for this purpose are likewise almost always prepared from highly concentrated hydrogen peroxide with the same disadvantages as heretofore stated.

In Grangaard, U.S. Pat. Nos. 3,607,687; 3,462,351; 3,507,769; and 3,592,749 there are disclosed electrolytic cells for the production of hydrogen peroxide in which the peroxide is produced in the cathode compartment of the cell which contains a cathode depolarized utilizing an oxygen containing gas. The electrochemical cells of Oloman et al and McIntyre et al disclosed in the patents cited above, are improvements over the cells of Grangaard partly as the result of the use of the novel electrode material disclosed in U.S. 4,457,953 in which there is disclosed a method for the production of coated particles for use in a packed bed electrode electrochemical cell.

It has been found that a packed bed electrode for maximum productivity within an electrochemical cell must be supplied with anolyte through an electrolyte porous diaphragm at a substantially uniform rate of flow across the porous diaphragm without appreciable variation of the flow rate as a function of the head of the electrolyte. Prior art porous diaphragms for packed bed electrolytic cells have permitted a considerable variation in flow rate with the flow rate at the base of the cell (exposed to the full head of the electrolyte) being appreciably faster than the flow rate in the center of the cell or at the top of the cell, where a decreased head pressure is exerted on the diaphragm. This variation in flow rate has resulted in inefficiency of the cell as the result of flooding or starvation of the packed bed cathode. Where an attempt has been made to reduce the flow rate through the cell diaphragm so as to prevent flooding of the packed bed cathode, it has been found that too little electrolyte passes through the porous diaphragm into the cathode (starvation) where the diaphragm is exposed to a minimal head of electrolyte. A reduced amount of electrolyte passing through the porous diaphragm into the cathode cell also results in an increase in cell voltage. An excessive amount of electrolyte passing through the porous diaphragm causes flooding of the packed bed cathode and consequent reduction in the depolarizing effect of the oxygen containing gas fed to the side of the packed bed cathode opposite to that which is exposed to the electrolyte.

SUMMARY OF THE INVENTION

A porous diaphragm for an electrochemical cell is disclosed consisting of an assembly which provides a substantially uniform electrolyte flow rate within a defined range of pressure of the electrolyte as a consequence of varying the head of electrolyte to which the diaphragm is exposed. The porous diaphragm of the invention comprises a plurality of layers of a microporous polyolefin film or a composite of a support fabric, resistant to deterioration upon exposure to electrolyte, and said microporous polyolefin film. The plural layered diaphragm can be prepared utilizing multiple or variable layers of said polyolefin film or said composite. Variable layered diaphragms have layers which vary in number from the top end to the bottom end of said diaphragm and have a greater number of layers in the bottom area of the porous diaphragm which is exposed to higher pressure as the result of a higher head level of the electrolyte. The force exerted on the diaphragm of the invention by head levels of about 6 to about 72 inches or more of electrolyte can be controlled by the diaphragm of the invention so that flow rate across the diaphragm of the invention can be held within the range of about 0.01 to about 0.5 milliliters per minute per square inch of diaphragm.

The porous diaphragm of the invention is useful in an electrochemical cell for reacting a liquid electrolyte with a gas particularly electrolytic cells for the production of hydrogen peroxide by the electrolysis of an alkali metal hydroxide or chlor-alkali cells for the electrolysis of an alkali metal halide to produce a halogen gas and an aqueous solution of an alkali metal hydroxide. The porous diaphragm is particularly useful in electrochemical cells having at least one electrode characterized as porous and self-draining. Such electrodes, are also termed packed bed electrodes. In addition to said porous diaphragm, an electrochemical cell utilizing the porous diaphragm of the invention in a cell having a packed bed cathode is disclosed. In addition, a method of providing substantially uniform flow across a porous diaphragm and a method for electrochemically reacting a liquid electrolyte with a gas in an electrochemical cell are also disclosed. The diaphragm of the invention is useful in electrochemical cells to separate an electrolyte having a higher concentration of ionizable compound from an electrolyte having a lower concentration of ionizable compound.

DETAILED DESCRIPTION OF THE INVENTION AND THE PREFERRED EMBODIMENTS

Figure 1:
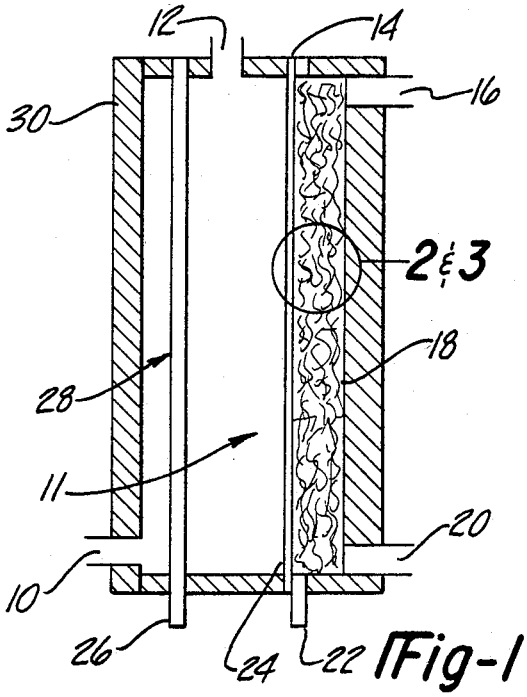
FIG. 1 is a schematic representation of a packed bed electrochemical cell utilizing the porous diaphragm of the invention.

In one embodiment of the invention illustrated in FIG. 1, a packed bed cathode 18 which is self-draining is shown as the cathode of an electrochemical cell 30 having an anode 26. Anolyte enters through anolyte inlet port 10 filling anolyte compartment 11 and, during operation of the cell, passes through porous diaphragm 24 so as to partially wet packed bed cathode 18 . The remainder of packed bed cathode 18 is filled with an oxygen containing gas which enters through gas inlet 16. The packed bed cathode 18 which is self-draining is electrically conductive and in contact with a current distributor 14 which is provided with an electrical connection 22. During operation of the electrochemical cell 30 a gas reaction product exits through gas outlet 12 and an aqueous product is removed through product outlet 20.

Figure 2:
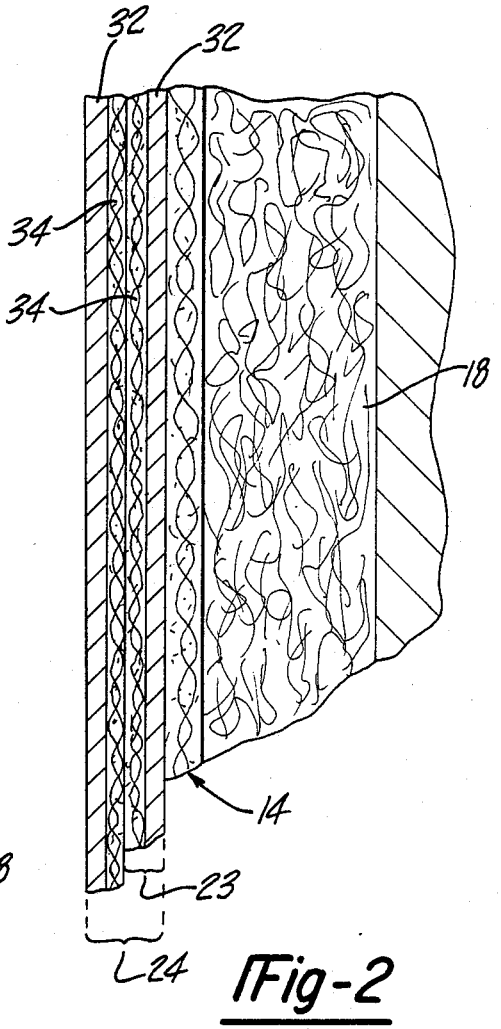
FIGS. 2 and 3 are enlarged schematic representations of that portion of the electrochemical cell of FIG. 1 within the circle in FIG. 1 so as to permit representation of the multiple or variable layers respectively of the porous diaphragm of the invention.

In FIG. 2 there is shown one embodiment of the multiple layered porous diaphragm of the invention 24 together with a current distributor 14 and a packed bed cathode 18. Said diaphragm comprises a composite of a support fabric 34 and a film of a microporous polyolefin 32 which is laminated thereto. In FIG. 2, two composite layers of the porous diaphragm of the invention are shown.

Figure 3:
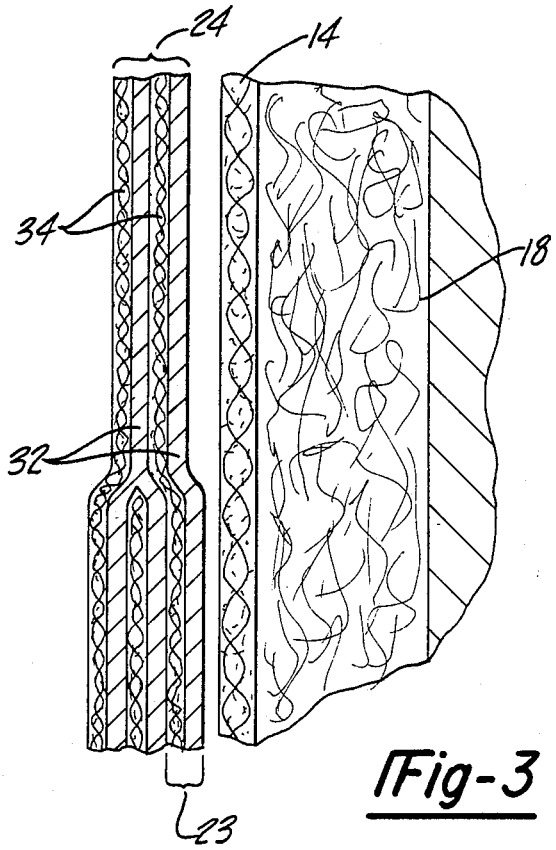

In FIG. 3 there is shown one embodiment of the variable layered porous diaphragm of the invention together with a current distributor and packed bed cathode. The porous diaphragm 24 comprises a combination of two layers of the composite support fabric and microporous polyolefin film laminate at one end of said diaphragm and a combination of three layers of said laminate at the opposite end of said diaphragm. The layers are held in position by any convenient means, not shown, such as by heaat sealing, sonic welding, etc. at one or more locations of the variable layered porous diaphragm. The microporous polyolefin film is shown as 32 and the support fabric is shown as 34.

Figure 4:
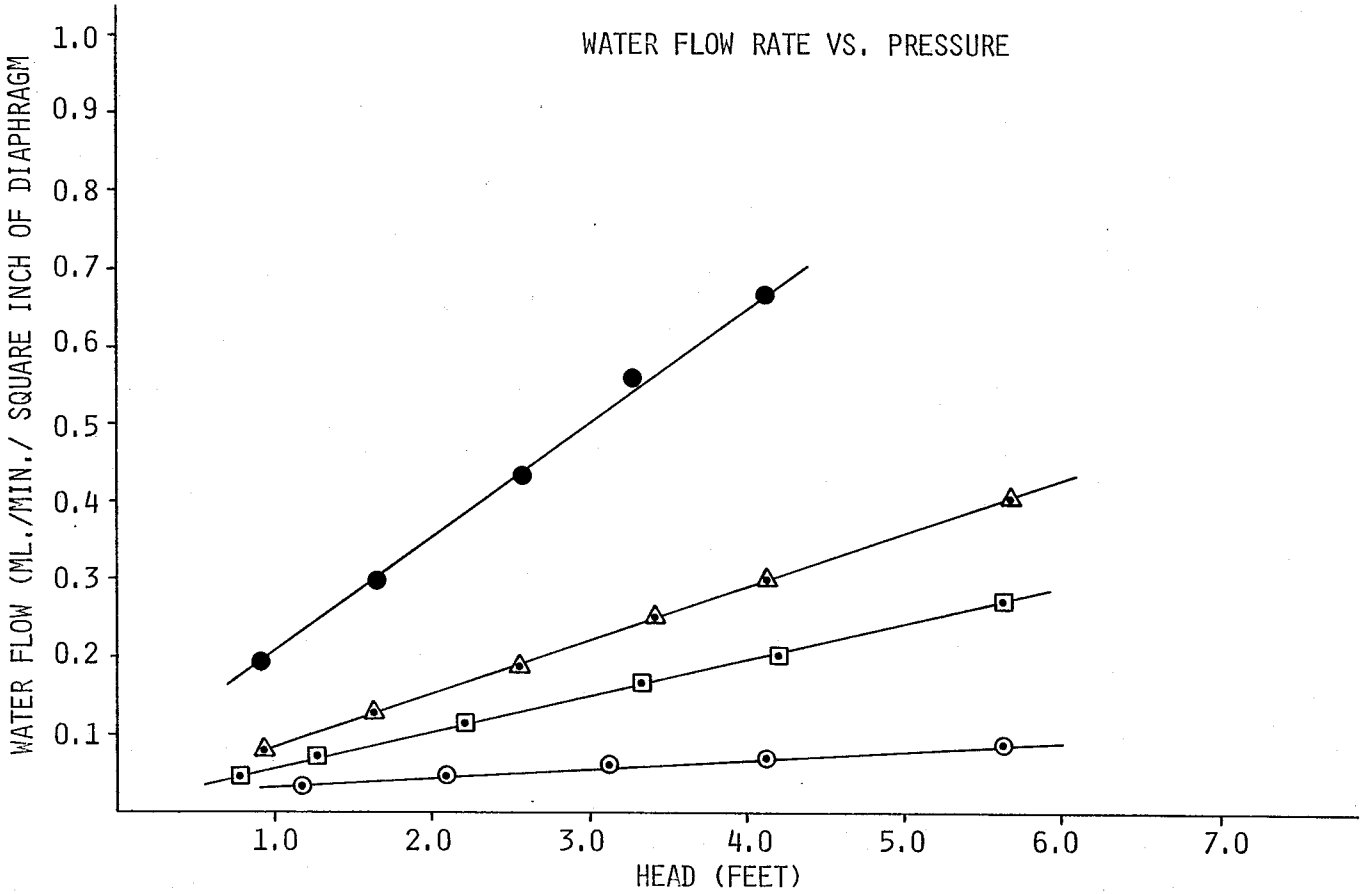
In FIG. 4 curves are shown of water flow through various layers of the microporous polyolefin film diaphragm material of the invention.

In FIG. 4, curves A, B, C, and D illustrate water flow rate vs head of water through a single layer or multiple layers of a composite diaphragm consisting of a polypropylene non-woven support fabric and a 1 mil thick microporous polypropylene film, said composite having a total thickness of 5 mils and sold under the trademark Celgard® 3501. Curve A was obtained using a single layer of said composite diaphragm material. Curve B was obtained using two layers of said composite, curve C was obtained using three layers of said composite, and curve D was obtained using four layers of said composite.

This invention relates to an improved electrolyte porous diaphragm for use in an electrochemical cell for carrying out a reaction in which a gas and a liquid electrolyte are brought into contact in a fluid permeable, packed bed electrode mass. Fixed, packed bed electrodes for use in electrochemical cells for carrying out, for instance, electrolysis reactions are known in the prior art from U.S. Pat. No. 4,118,305. A packed bed electrode utilizing a downward flow of electrolyte through a fixed bed electrode material is termed a trickle bed electrode.

There are several problems relating to the use of trickle bed electrodes that tend to prevent their exploitation in commercial processes. One of these problems is the difficulty of providing a substantially uniform flow of electrolyte from the anolyte compartment through the electrolyte permeable diaphragm to the electrode over the entire range of practical electrolyte head levels. In electrolytic cells operating at atmospheric pressure having an electrolyte head of from 0.5 foot to 6 feet or more, the uneveness of flow of anolyte through the electrolyte permeable cell diaphragm to the fixed bed cathode is readily apparent. At the lower portion of a vertical cathode which is exposed to the full height of the anolyte, flooding of a portion of fixed bed cathode can occur while at the same time at the opposite end, which is exposed to only a small fraction of the anolyte liquid head, the fixed bed cathode is subjected to an insufficient flow of anolyte and therefore there results insufficient wetting of the fixed bed cathode which causes an increase in cell voltage.

In order to avoid flooding of a fixed bed cathode, the prior art has suggested the use of special waterproofed electrodes and/or attempted to balance the anolyte pressure with the gas pressure across the fixed bed cathode. One method of controlling the flow through the cell separator is to operate the anolyte compartment under either gas or liquid pressure. In this method the anolyte chamber of the electrolytic cell is sealed from the atmosphere and gas pressure or liquid pressure is exerted upon the electrolyte. High pressure pumps can be used to force a pressurized liquid into the opposing catholyte compartment or pressurized gas can be fed to the cathode compartment. Alternatively the pressure drop across the cell diaphragm can be regulated by pulling a vacuum on the fixed bed cathode side of the cell separator. This will pull the electrolyte toward and through the separator and finally into the fixed bed cathode. These methods have not proven commercially acceptable and have led to further research effort, the results of which form the basis of this invention.

An electrolytic cell utilizing at least one packed bed electrode is useful in the production of chlorine and alkali metal hydroxide and is particularly useful in the production of hydrogen peroxide. Where a fixed bed, gas diffusion cathode is utilized for the electrolysis of, for example, sodium chloride, chlorine is produced in the anode compartment of the cell and aqueous sodium hydroxide is produced in the catholyte compartment of the cell. Hydrogen, which would normally be produced at the cathode is not produced when an oxygen containing depolarizing gas is fed to a gas diffusion cathode, thus effecting a saving in cell voltage. In the prior art, the cathodes developed for utilization of oxygen as a depolarizing gas were characterized by a structure composed of a thin sandwich of a microporous separator of plastic film combined with a catalyzed layer which is wetproofed with a fluorocarbon polymer. Such gas depolarized cathodes generally contain a wire screen current distributor for distributing current to the catalyzed layer of the electrode. An oxygen containing gas is fed into the catalyzed layer zone of the cathode through a microporous backing. Such cathodes have suffered from various deficiencies including delamination of the various layers during operation in the cell and the ultimate flooding by electrolyte of the catalyzed layer leading to inactivation of the cathode and shut down of the cell. The fixed bed electrodes described above are an improved form of gas depolarized cathode for use in the production of hydrogen peroxide or chlorine and an alkali metal hydroxide.

Electrolytic cells for the reduction of oxygen to peroxide have been described in the prior art as utilizing one side of a porous carbon plate in contact with the electrolyte and an oxygen containing gas delivered to the opposite side of the plate for reaction within the plate. These porous gas diffusion electrodes require careful balancing of oxygen and electrolyte pressure to keep the reaction zone confined evenly just below or on the surface of the porous plate. The packed bed cathode described in U.S. Pat. No. 4,118,305 is an improved form of electrode as compared to the above porous carbon plate for use in an electrolytic cell utilized in the preparation of hydrogen peroxide.

The electrochemical cell of the invention comprises a pair of spaced apart electrodes, at least one of said electrodes being in the form of a fluid permeable conductive mass termed a fixed bed electrode. In the preparation of chlorine and caustic or in the preparation of an alkaline aqueous solution of hydrogen peroxide by electrolysis, the fixed bed electrode is a cathode. The electrodes of the electrochemical cell of the invention are separated by an electrolyte permeable porous diaphragm composed of an assembly having a plurality of layers of a microporous polyolefin film or a composite material comprising a supporting fabric resistant to degradation upon exposure to electrolyte and said microporous polyolefin film.

The electrochemical reaction for the production of hydrogen peroxide is conducted by recirculating a liquid aqueous solution of an alkali metal hydroxide as electrolyte through an anolyte compartment at a linear velocity generally of about 0.05 inches per second to about 75 inches per second, preferably about 0.1 to about 30, and most preferably about 0.5 to about 10 inches per second. Gas is simultaneously flowed into at least a portion of the pores of a self-draining electrode. The gas is an oxygen containing gas and the self-draining electrode is a cathode in the electrolysis of an aqueous alkali metal hydroxide solution to produce hydrogen peroxide. Electrolyte is simultaneously flowed from the anolyte compartment through the plural layered liquid electrolyte permeable diaphragm of the invention into a porous, self-draining electrode at a rate about equal to the drainage rate of said electrode. The flow rate through said diaphragm is determined by the differential pressure on said diaphragm. On the cathode side of the diaphragm, the pressure may be at atmospheric pressure or above as the result of flowing a gas under pressure into the cathode bed of loose particles. The pressure on the anode side of said diaphragm is the result of maintaining a head of anolyte on the diaphragm. The head of anolyte is specified herein as the total head, as measured from the bottom of the diaphragm to the top of the anolyte liquid. Thus the effective pressure which causes the flow of anolyte through the cell diaphragm is the pressure exerted on the anolyte side of said diaphragm by the head pressure of the anolyte minus the pressure exerted on the catholyte side of said diaphragm by the gas which is fed into the cathode of the cell. The self-draining cathode generally has a thickness of about 0.1 to about 2.0 centimeters in the direction of current flow. The cathode can be in the form of a bed of loose particles or a fixed porous matrix. It is generally composed of a conductive material which may also be a good electrocatalyst for the reaction to be carried out. In the reduction of oxygen to hydrogen peroxide, graphite particles have been found to be suitable for forming the cathode mass because the graphite is cheap, conductive, and requires no special treatment. For other reactions, graphite or other forms of carbon or tungsten carbide can be used as well as certain metals such as platinum, iridium, or metal oxides such as lead dioxide or manganese dioxide coated on a conducting or nonconducting substrate. The graphite particles typically have diameters in the range of about 0.005 to about 2.0 centimeters. It is the bed of particles which acts as the cathode in the electrochemical reaction. Generally the self-draining cathode is supplied with current through a current distributor which can be a metal mesh which is held in contact with the cathode. The cathode is supplied, with an oxygen containing gas so as to depolarize the cathode during operation of the cell and to prevent the formation of hydrogen at the cathode during the electrolysis.

The electrochemical cell of the invention which can be a monopolar or bipolar cell, for instance, an electrolytic cell utilized for the production of chlorine and sodium hydroxide or the production of hydrogen peroxide, contains a cell separator, or diaphragm, separating an anolyte compartment and a catholyte compartment which contain respectively the anode and cathode of the cell. Generally the cell diaphragm is vertically positioned and in contact with the self-draining cathode. The cell diaphragm can also be indirectly or directly supported by the self-draining cathode. The current distributor is often positioned between the self-draining cathode and the cell diaphragm.

The cell diaphragm of the invention comprises an assembly having a plurality of layers of a microporous polyolefin film diaphragm material or a composite comprising a support fabric resistant to degradation upon exposure to electrolyte and said microporous polyolefin film. In the diaphragm of the invention multiple layers of said porous film or composite are utilized. No necessity exists for holding together the multiple layers of the diaphragm. At the peripheral portions thereof, as is conventional, or otherwise, the diaphragm is positioned within the electrolytic cell. Multiple diaphragm layers of from two to four layers have been found useful in reducing the variation in flow of electrolyte through the cell diaphragm over the usual and practical range of electrolyte head. Portions of the diaphragm of the invention which are exposed to the full head of electrolyte as compared with portions of the cell diaphragm which are exposed to little or no electrolyte head pass substantially the same amount of electrolyte to the cathode.

As an alternative means of producing a useful multiple layer vertical diaphragm, it has been found desirable to prepare a cell diaphragm of the invention having variable layers of the defined porous composite diaphragm material. Thus it is suitable to utilize one to two layers of the defined porous composite material in areas of the cell diaphragm which are exposed to relatively low pressure as the result of being positioned close to the surface of the body of electrolyte while utilizing two to six layers of the defined composite porous material in areas of the diaphragm exposed to moderate or high pressure of the electrolyte. A preferred construction is two layers of the defined composite porous material at the top or upper end of the diaphragm and three layers of said composite at the bottom of said diaphragm.

For use in the preparation of chlorine and sodium hydroxide or in the preparation of hydrogen peroxide, a polypropylene woven or non-woven fabric support layer has been found acceptable for use in the formation of the composite diaphragm of the invention. Alternatively there can be used any polyolefin, polyamide, or polyester fabric or mixtures thereof and each of these materials can be used in combination with asbestos in the preparation of the supporting fabric. Representative support fabrics include fabrics composed of polyethylene, polypropylene, polytetrafluoroethylene, fluorinated ethylenepropylene, polychlorotrifluoroethylene, polyvinyl fluoride, asbestos, and polyvinylidene fluoride. A polypropylene support fabric is preferred. This fabric resists attack by strong acids and bases. The composite diaphragm is characterized as hydrophilic, having been treated with a wetting agent in the preparation thereof. In a 1 mil thickness, the film portion of the composite has a porosity of about 38% to about 45%, and an effective pore size of 0.02 to 0.04 micrometers. A typical composite diaphragm consists of a 1 mil thick microporous polyolefin film laminated to a non-woven polypropylene fabric with a total thickness of 5 mils. Such porous material composites are available under the trade designation Celgard ® from Celanese Corporation. Utilizing multiple layers of the above described porous material as an electrolytic cell diaphragm, it is possible to obtain a flow rate within an electrolytic cell of about 0.01 to about 0.50 millileters per minute per square inch of diaphragm, generally over a range of electrolyte head of 0.5 foot to 6 feet, preferably 1 to 4 feet. Preferably said flow rate over said range of electrolyte head, is about 0.03 to about 0.3 and most preferable is about 0.05 to about 0.1 milliliters per minute per square inch of diaphragm. Cells operating at above atmospheric pressure on the cathode side of the diaphragm would have reduced flow rates at the same anolyte head levels since it is the differential pressure that is responsible for electrolyte flow across the diaphragm.

Self-draining, packed bed cathodes are disclosed in the prior art such as in U.S. Pat. Nos. 4,118,305; 3,969,201; 4,445,986; and 4,457,953 each of which are hereby incorporated by reference. The packed bed cathode is typically composed of graphite particles, however other forms of carbon can be used as well as certain metals. The packed bed cathode has a plurality of interconnecting passageways having average diameters sufficiently large so as to make the cathodes self-draining, that is, the effects of gravity are greater than the effects of capillary pressure on an electrolyte present within the passageways. The diameter actually required depends upon the surface tension, the viscosity, and other physical characteristics of the electrolyte present within the packed bed electrode. Generally the passageways have a minimum diameter of about 30 to about 50 microns. The maximum diameter is not critical. The self-draining cathode should not be so thick as to unduly increase the resistance losses of the cell. A suitable thickness for the packed bed cathode has been found to be about 0.03 inch to about 0.25 inch, preferably about 0.06 inch to about 0.2 inch. Generally the packed bed cathode is electrically conductive and prepared from such materials as graphite, steel, iron, and nickel. Glass, various plastics, and various ceramics can be used in admixture with conductive materials. The individual particles can be supported by a screen or other suitable support or the particles can be sintered or otherwise bonded together but none of these alternatives is necessary for the satisfactory operation of the packed bed cathode.

An improved material useful in the formation of the packed bed cathode is disclosed in U.S. Pat. No. 4,457,953 comprising a particulate substrate which is at least partially coated with an admixture of a binder and an electrochemically active, electrically conductive catalyst. Typically the substrate is formed of an electrically conductive or nonconductive material having a particle size smaller than about 0.3 millimeters to 2.5 centimeters or more. The substrate need not be inert to the electrolyte or to the products of the electrolysis of the process in which the particle is used but is preferably chemically inert since the coating which is applied to the particle substrate need not totally cover the substrate particles for the purposes of rendering the particle useful as a component of a packed bed cathode. Typically the coating on the particle substrate is a mixture of a binder and an electrochemically active, electrically conductive catalyst. Various examples of binder and catalyst are disclosed in U.S. Pat. No. 4,457,953.

Stablizing agents suitable for addition to the electrolyte solution of an electrolytic cell for the production of hydrogen peroxide are disclosed in U.S. Pat. No. 4,431,494, incorporated herein by reference. Such stabilizing agents include compounds that form chelates with impurities found to be catalysts for the decomposition of the hydrogen peroxide produced within the cell. Specific stabilizing agents include alkali metal salts of ethylene-diaminetetraacetic acid, stannates, phosphates, and 8-hydroxyquinoline.

In an electrolytic cell where aqueous sodium or potassium hydroxide is desired as a product, generally the brine is fed to the anolyte compartment of the electrolytic cell at a pH of about 1.5 to about 5.5. Typically the sodium or potassium chloride is fed at a saturated or substantially saturated concentration containing from about 300 to about 325 grams per liter of sodium chloride or from about 450 to about 500 grams per liter of potassium chloride. The catholyte liquor recovered from the electrolytic cell can contain approximately 10 to 12 weight percent sodium hydroxide and 15 to 25 weight percent sodium chloride or approximately 15 to 20 weight percent potassium hydroxide and approximately 20 to 30 weight percent potassium chloride when the electrolytic cell is used with the cell separator of the invention.

In an electrolytic cell for the production of hydrogen peroxide, typically the anolyte liquor is an aqueous solution containing about 15 to 100 grams per liter of sodium hydroxide. The catholyte liquor recovered from the electrolytic cell can contain approximately 0.5 to 6 weight percent hydrogen peroxide and 15 to 200 grams per liter sodium hydroxide when the electrolytic cell is used with the cell diaphragm of the invention.

The anode of the electrolytic cell of the invention is typically formed from a valve metal, for example titanium, tantalum, tungsten, columbium, or the like with a suitable electrode catalytic surface coated thereon. Suitable anodic electrocatalytic surfaces are well known in the art and include transition metals, oxides of transition metal compounds, especially platinum group metal oxides. Especially preferred are mixtures of oxides of platinum group metals with oxides of the valve metals referred to above.

The following examples illustrate the various aspects of the invention but are not intended to limit its scope. Where not otherwise specified throughout this specification and claims, temperatures are given in degrees centigrade, and parts, percentages, and proportions are by weight.

EXAMPLE 1

An experiment was set up to simulate the liquid flow through a single or multiple layered separator. An electrolysis cell, with anolyte and catholyte compartments, separated by a 6" high by 1" wide opening in which the test separators were placed, was used. With no electrical current applied, the water flow rates through various layers of separator, at various hydraulic heads, were measured. One to four plies or layers of a composite of a non-woven polypropylene support fabric and a 1 mil thick microporous polypropylene film, said composite having a total thickness of 5 mils and sold under the trademark Celgard® 5511 were used. The results are plotted in FIG. 4 (curves A–D). As shown in the FIG. 4, the more layers of separator used, the lower the variation of flow with hydraulic head. Using more layers therefore would allow a taller electrolytic cell to be used thus saving valuable floor space, while obtaining the uniform flow required for proper operation of the trickle bed electrode.

EXAMPLE 2

An electrochemical cell for the production of alkaline peroxide was set up as follows. A cathode trickle bed of composite chips was formed essentially as described by McIntyre et al in Example 1 of U.S. Pat. No. 4,457,953, incorporated herein by references, in a plastic cell body, with a Ni screen current collector in contact with the bed.

The anode compartment of said cell contained a precious metal coated titanium anode similar to that commercially available as DSA®. The electrochemical cell was constructed and operated substantially as described in U.S. Pat. No. 4,457,953 except that a microporous polypropylene film diaphragm was placed between the anode and cathode compartments. The diaphragm consisted of three layers of a microporous polypropylene film sold under the trademark Celgard® 5511.

The cell was therefore set up essentially as depicted in FIG. 1. When operated at room temperature and 1.65A, with one molar NaOH feed to the anolyte compartment, and $O_2$ gas fed to the cathode compartment, the cell produced hydrogen peroxide at 89.1% current efficiency at a concentration of hydrogen peroxide of 36 grams per liter.

EXAMPLE 3

An electrolysis cell was set up and operated substantially as in Example 2, except that 2 layers of a composite consisting of a 1 mil microporous polypropylene film and a 4 mil non-woven polypropylene support fabric sold under the trademark Celgard® 3501 were used. The current was 1.2A and the current efficiency was 91.4% with a hydrogen peroxide concentration of 25 grams per liter.

EXAMPLE 4

An electrolysis cell was set up and operated substantially as in Example 2, except that the diaphragm consisted of 2 layers of a microporous polypropylene film sold under the trademark Celgard® 5511 at the top half of the cell, and 3 layers of a microporous polypropylene film sold under the trademark Celgard® 5511 at the bottom half. A nickel mesh anode was used. The cell was operated at 1.5A at 83.5% current efficiency. A hydrogen peroxide concentration of 17 grams per liter was obtained.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

The embodiments of the invention in which an exclusive property or priviledge is claimed are defined as follows:

1. A porous diaphragm for use in electrochemical cells having at least one electrode characterized as porous and self-draining, said diaphragm consisting of an assembly having variable layers of a microporous polyolefin film or an assembly having variable layers of a composite diaphragm comprising said microporous polyolefin film and a support fabric resistant to deterioration upon exposure to an aqueous solution of an ionizable compound and electrolysis products thereof, said support fabric being laminated to said microporous polyolefin film, the number of variable layers of said diaphragm varying from the top of said porous diaphragm to the bottom of said porous diaphragm, and said porous diaphragm being adapted for use in the electrolysis of an aqueous solution comprising an alkali metal halide or an alkali metal hydroxide.

2. The porous diaphragm of claim 1 wherein said diaphragm consists of 1 to 6 layers of said composite and said support fabric is woven or non-woven fabric selected from the group consisting of polyolefins, polyesters, asbestos, polyamides, and mixtures thereof.

3. The porous diaphragm of claim 2 wherein said diaphragm consists of a combination of two layers of said composite at the top of said diaphragm and three layers of said composite at the bottom of said diaphragm and said support fabric is selected from the group consisting of polytetrafluoroethylene, fluorinated ethylenepropylene, polychlorotrifluoroethylene, polyvinyl fluoride, polyvinylidene fluoride, and mixture thereof.

4. The porous diaphragm of claim 3 wherein said microporous film is characterized as being hydrophilic, as having a porosity of about 38%, to about 45%, an pore size of about 0.02 to about 0.04 micrometers, and a thickness of about 1 mil.

* * * * *